US005241475A

United States Patent [19]

Lee et al.

[11] Patent Number: 5,241,475

[45] Date of Patent: Aug. 31, 1993

[54] METHOD OF EVALUATING FLUID LOSS IN SUBSURFACE FRACTURING OPERATIONS

[75] Inventors: Wellington S. Lee, Duncan; David E. McMechan; Billy W. McDaniel, both of Marlow, all of Okla.

[73] Assignee: Halliburton Company, Duncan, Okla.

[21] Appl. No.: 604,670

[22] Filed: Oct. 26, 1990

[51] Int. Cl.[5] ..... G01V 1/00

[52] U.S. Cl. ..... 364/420; 364/422; 73/38; 73/155

[58] Field of Search ..... 364/420, 422; 166/308, 166/250, 259, 305.1; 73/155, 38

[56] References Cited

U.S. PATENT DOCUMENTS

| | | | |
|---|---|---|---|
| 3,933,205 | 1/1976 | Kiel | 166/308 |
| 4,836,280 | 6/1989 | Soliman | 166/250 |
| 4,848,461 | 7/1989 | Wellington | 166/250 |
| 5,050,674 | 9/1991 | Soliman et al. | 73/155 |

OTHER PUBLICATIONS

"Recent Advances in Hydraulic Fracturing", 1989, 2 cover pages, Chapter 4 cover page, pp. 88–89, 92–93, 227, 231, and 300, by John L. Gidley, Stephen A. Holditch, Dale E. Neirode, and Ralph W. Veatch Jr.

"Determination of Fracture Parameters from Fracturing Pressure Decline," SPE 8341, published 1979, pp. 1–16, by Kenneth G. Nolte.

"Field Application of Minifrac Analysis to Improve Fracturing Treatment Design", SPE 17463, pp. 235–256, published 1988, by H. C. Tan, J. M. Mcgowen, W. S. Lee, and M. Y. Soliman.

"Reservoir Stimulation", 1987, Chapter 7, pp. 7-1--7-17, by Michael J. Economides and Kenneth G. Nolte.

*Primary Examiner*—Roy N. Envall, Jr.
*Assistant Examiner*—Frantzy Poinvil
*Attorney, Agent, or Firm*—Arnold, White & Durkee

[57] ABSTRACT

An implementation of the present invention will typically be performed through use of two test fracturing or "mini-frac" operations to determine formation parameters. A first mini-frac operation will be performed to determine the fluid efficiency of the formation, and a second mini-frac operation will be performed to determine a late time fluid leak-off coefficient. The data thus obtained will be functionally related to simultaneously solve integral expressions to determine the total volume of fluid lost during pumping and the total volume of fluid lost during shut-in in response to an assumed spurt time. The fluid loss values will then be functionally related to the established fluid efficiency to estimate an early time fluid leak-off coefficient. The early time fluid leak-off coefficient thus determined will then be applied in a balance equation to verify the accuracy of such value in response to the assumed spurt time. The assumed spurt time may then be varied and the above fluid loss values iteratively reevaluated until the balance equation is satisfied within an acceptable range of tolerance.

12 Claims, 1 Drawing Sheet

METHOD OF EVALUATING FLUID LOSS IN SUBSURFACE FRACTURING OPERATIONS

BACKGROUND OF THE INVENTION

The present invention relates generally to improved methods for designing fracturing programs for fracturing subsurface formations, and more specifically relates to improved methods for evaluating fluid loss through use of small scale, test fracture operations and analysis, commonly known as "mini-frac" operations, and utilizing such evaluated fluid loss to design subsurface formation fracturing programs.

Mini-frac operations consist of performing small scale fracturing operations utilizing a relatively small quantity of fluid, which typically contains little or no proppant. After the test fracturing operation, the well is shut-in and the pressure decline of the formation is observed over time. The data thus obtained is used in a fracture model to establish parameters of the formation fracturing program.

Mini-frac test operations are significantly different from conventional full scale fracturing operations in that only a small amount of fracturing fluid is typically injected, for example, as little as about twenty-five barrels; and no significant amount of proppant is typically utilized. The desired result is not a propped formation fracture of practical value, but a small scale, short duration fracture to facilitate the collection of pressure decline data regarding the fracturing fluid in the formation. This pressure decline data will facilitate the estimation of formation, fluid, and fracture parameters.

One major factor in the design of a fracturing program is the rate of fluid loss into the formation. One of the primary uses of mini-frac analysis is to determine the fluid loss coefficient of the formation. Conventional methods and analytical techniques determine the effective fluid loss coefficient ($C_{eff}$) as a weighted average of the coefficient of early time fluid loss ($C_{vc}$) and the coefficient of late time fluid loss ($C_w$). The coefficient of early time fluid loss ($C_{vc}$) is primarily a function of the fracturing fluid encountering the porosity of the formation. The coefficient of late time fluid loss ($C_w$) is primarily established when a filter cake has built up on the formation, thereby reducing fluid loss into the formation.

If the primary fluid loss during a mini-frac operation occurs at the spurt loss rate (i.e., if the spurt volume is very large), the fluid loss during a small mini-frac may be dominated by such fluid loss volume. If this value is then used to calculate an effective fluid loss coefficient ($C_{eff}$), then the actual fluid loss which would occur over a long pumping time of an actual fracturing program would be much less than estimated (i.e., the predicted fluid loss would be much greater than would actually occur). Accordingly, a fracturing program designed upon such estimated fluid loss would typically include a large pad volume (i.e., the fluid injected prior to the injection of proppant). Such errors may be extreme, and may, in some cases, effectively preclude the practicality of performing fracturing operations. For example, a typical fracturing job may use seventy-five thousand to one hundred thousand gallons of fracturing fluid, which may cost, for example, approximately one dollar per gallon. The fluid pad of the fracturing program, which is determined directly in response to the fluid loss coefficient, may be anywhere from twenty percent to ninety percent of the fracturing fluid utilized. As is readily apparent, if the fluid pad is appreciably overestimated, the cost of fluid for the fracturing operation may be excessively high. In some cases, the overly high estimated fluid loss may indicate that a pumping rate is required which is beyond the capacity of conventional equipment. In such cases, the overestimated fluid loss would indicate that a fracturing program was impractical when, in fact, such would not be the case.

The fracture dimensions (i.e., the length, width and height) are a direct function of the total volume of fluid in the fracture, and are therefore directly dependent upon the leak-off rate of the fluid. Fluid efficiencies in fracturing operations are typically encountered in the range from less than 10% fluid efficiency to greater than 90% fluid efficiency. The increase in reservoir production which makes a fracturing operation economically desirable, is also directly related to the fracture dimensions through the formation. Accordingly, an improvement in estimating fracture performance through improved evaluations of fluid leak-off can offer substantial practical and commercial advantage.

Conventional techniques for designing fracturing programs have typically included a variable for the early time fluid loss, but conventional mini-frac analytical techniques have required the assumption that the value of such is zero. As will be readily appreciated, in applications where the early time fluid loss is low, this method will yield reasonable results. However, where the early time fluid loss is high (i.e., such as in highly permeable formations), the method will result in an overestimate of fluid loss and in all probability an overestimate of the pad volume and/or pumping rate.

Accordingly, the present invention provides a new method and apparatus for evaluating the early time fluid loss and the late time fluid loss and the coefficients representative thereof, and for using such distinct fluid loss coefficients to determine parameters of a fracturing program.

SUMMARY OF THE INVENTION

In a preferred method of implementing the present invention, a two stage mini-frac procedure will be performed. Both mini-frac operations will preferably be performed using the same fracturing fluid; and the duration of the second mini-frac treatment will preferably be approximately 0.5 to 0.75 times the duration of the first mini-frac treatment.

The results of each mini-frac will be analyzed to obtain individual data estimates of fluid loss coefficients, fluid efficiencies, fracture lengths, fracture widths, closure time, etc. Because the fluid utilized by the second mini-frac will, ideally, go through a fracture where the filter cake has been completely built, the fluid loss coefficient determined relative to the second mini-frac is evaluated as representative of the late time fluid loss. A laboratory-determined spurt volume ($V_{sp}$), will be utilized, to determine a maximum spurt time ($t_{max}$). This initial maximum spurt time will then be utilized in appropriate integral expressions to simultaneously solve for the total fluid loss during shut-in ($V_{lc}$)and the total fluid loss during pumping ($V_{1P}$). These determined values will then be related to the established fluid efficiency to determine the early time fluid leak-off coefficient. This fluid efficiency will be as determined from the pressure decline data for the first mini-frac operation.

This determined early time fluid loss coefficient will be functionally related to the known spurt loss volume, as empirically determined, and the assumed spurt time in a balance equation. If the assumed spurt time and determined early time fluid loss coefficient do not satisfy the balance equation, another, smaller, magnitude of spurt time may be assumed, and the integral expressions for the fluid loss during shut-in and the fluid loss during pumping will be iteratively solved until the determined early time fluid loss coefficient and assumed spurt time satisfy the balance equation relative to the known spurt volume within an acceptable degree of tolerance.

BRIEF DESCRIPTIONS OF THE FIGURES

FIG. 1 graphically depicts the contributions of the early time fluid loss coefficient and the late time fluid loss coefficient to a curve representative of the leak-off time as a function of dimensionless distance.

DETAILED DESCRIPTION OF PREFERRED EMBODIMENTS

Figure 1:
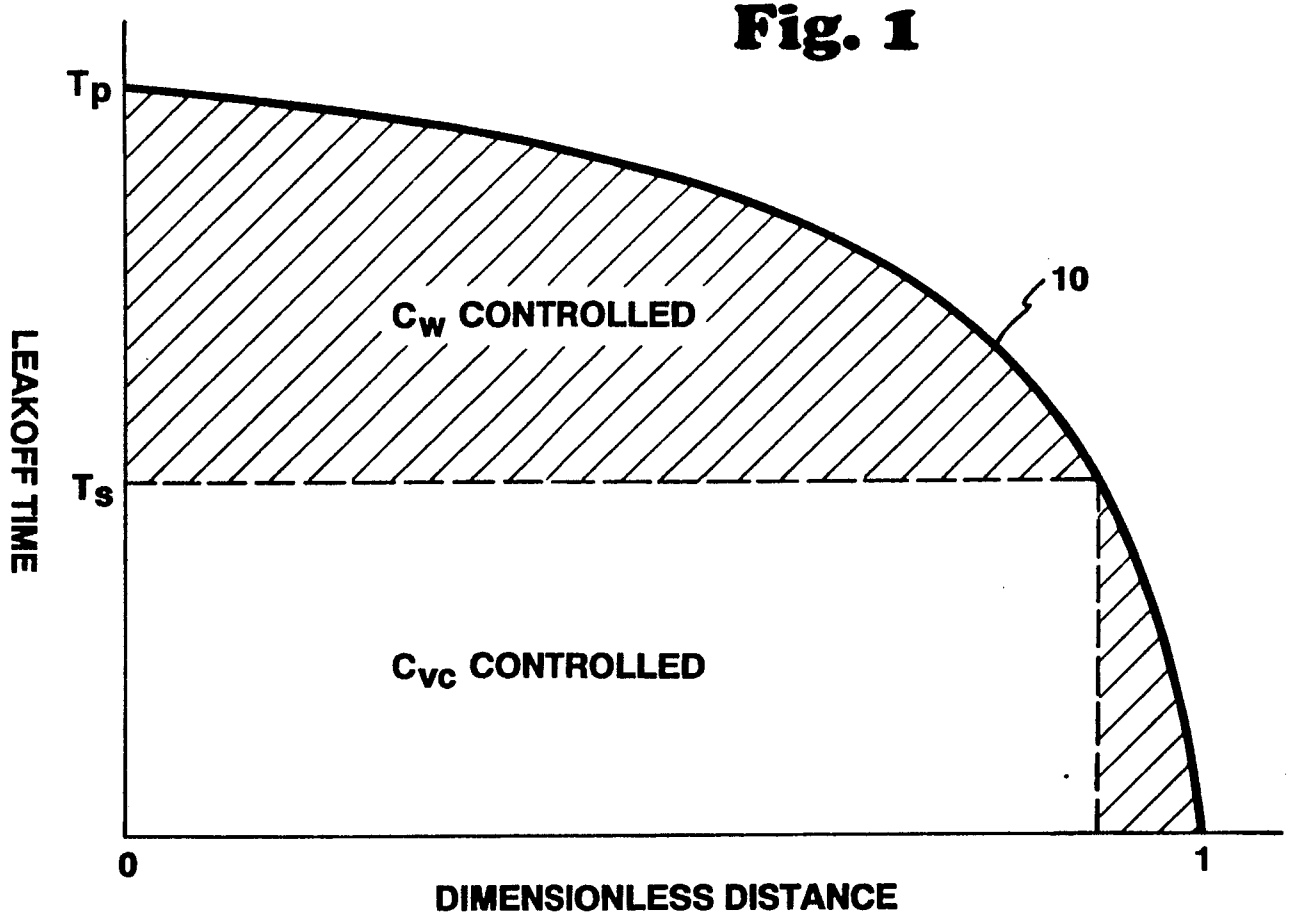

Referring now to FIG. 1, FIG. 1 graphically depicts the fluid leak-off time in a formation as a function of dimensionless distance. As can be seen in FIG. 1, the majority of the volume underneath curve 10 until the spurt time ($t_s$), is controlled by the early time fluid loss coefficient ($C_{vc}$). This early time fluid loss coefficient, as discussed earlier herein, is largely dependent upon the porosity of the formation being fractured. After the spurt time, the leak-off time is controlled by the late time fluid loss coefficient ($C_w$). The present invention provides a new method and apparatus to evaluate fluid performance in fracture propagation in response to the distinct controls presented by the early and late time fluid loss coefficients.

In a preferred method of practicing the invention, as indicated earlier herein, two mini-frac treatments will be performed. Preferably, the shut-in period for each mini-frac treatment will be at least twice as long as the pumping time. Additionally, the second mini-frac treatment will preferably be performed using the same fracturing fluid as is used in the first mini-frac test. The relatively long shut-in period of the first mini-frac is utilized to help insure that the fracture is closed prior to the start of the second mini-frac. The fluid utilized in the second mini-frac will then be most likely to pass through a fracture where the filter cake has been completely built, so as to accurately represent late time fluid loss. Care should be taken under the operating conditions present (i.e., formation characteristics, fracturing fluid characteristics, temperature, etc.), to not have too great a shut-in time after pumping for the first mini-frac operation and before pumping for the second mini-frac operation, as such might result in the created filter cake being dissolved or otherwise degraded.

Due to the greater fluid efficiency which would be expected in the second mini-frac due to the late time fluid loss coefficient, the second mini-frac will preferably be of a shorter duration, such as 0.5 to 0.75 times as long as the first mini-frac, to help avoid the creation of a longer fracture. If the fracture were lengthened during the second mini-frac, the fracturing fluid would pass through freshly created surfaces, and not an established filter cake, and therefore such losses would not be representative of late time fluid loss. Accordingly, a lengthened fracture would introduce error into the initial measurements. It will be readily appreciated that if the spurt time is long while the closure time is relatively short, indicative of a high fluid leak off rate, the second mini-frac duration should be shortened even further to help ensure that the measurement is representative of fluid passing only through a filter cake, and is therefore truly representative of the late time fluid leak-off.

The spurt volume ($V_{sp}$) may be empirically determined by conventional laboratory methods. The maximum spurt time ($t_{max}$) may then be estimated from the relationship:

$$V_{sp}=2C_w t_{max}^{\frac{1}{2}} \qquad \text{EQUATION 1}$$

where

The maximum spurt time ($t_{max}$) should be greater than the spurt time ($t_s$) because the late time fluid loss coefficient ($C_w$) is less than the early time fluid loss coefficient ($C_{vc}$).

Four practical categories can be defined based upon the magnitude of the spurt time ($t_s$). The first category is where the spurt time is greater than the sum of the closure time and the pumping time, and may be numerically represented as follows:

$$t_s >= t_p + t_c \qquad \text{EQUATION 2}$$

where:

$t_p$ represents the pumping time; and $t_c$ represents the closure time.

In this circumstance, the filter cake has not been completely built anywhere over the fractured area at closure time. Accordingly, the fluid loss is governed entirely by the early time fluid loss coefficient, and thus may be assigned the value of $C_{vc}$.

The second category, where the spurt time is greater than the pumping time but less than or equal to the sum of the pumping time and the closure time may be numerically represented as follows:

$$t_s > t_p, \text{ and } t_s \leqq t_p + t_c \qquad \text{EQUATION 3}$$

The third category is defined where the closure time is less than or equal to the spurt time which is less than the pumping time:

$$t_c \leqq t_s \leqq t_p \qquad \text{EQUATION 4}$$

The fourth category is defined by the spurt time being less than both the pumping time and the closure time:

$$t_s < t_p, \text{ and } t_s < t_c \qquad \text{EQUATION 5}$$

Generally, in each of categories two through four, where the late time fluid loss will control a portion of the fluid loss, category two will generally represent the highest magnitude of spurt time ($t_s$). Where ($t_{max}$) is estimated to fall within category two, integral expressions for $V_{1p}$ and $V_{1c}$ will be simultaneously solved, utilizing the estimated maximum spurt time from equation 1 as the spurt time ($t_s$) in the following integral expression:

EQUATION 6

$$V_{1c} = 4H_n \int_0^{L_s} \left[ \int_{t_p}^{t_s + t_x} C_{vc} + \int_{t_s + t_x}^{t_c + t_p} C_w \right] \frac{dx\,dt}{(t - t_x)^{\frac{1}{2}}} +$$

-continued $$4H_n \int_{L_s}^{L_p} \int_{t_p}^{t_c + t_p} C_{vc} \frac{dxdt}{(t - t_x)^{\frac{1}{2}}}$$

EQUATION 7

$$V_{1p} = 4H_n \int_0^{L_s} \left[ \int_0^{t_s + t_x} C_{vc} + \int_{t_s + t_x}^{t_p} \right] C_w \frac{dxdt}{(t - t_x)^{\frac{1}{2}}} + 4H_n \int_{L_s}^{L_p} \int_{t_x}^{t_p} C_{vc} \frac{dxdt}{(t - t_x)^{\frac{1}{2}}}$$

where:

$H_n$ represents the pay height of the formation of interest, which will be known from conventional techniques;

$L_s$ represents the halfwing created length, with the pumping time equal to the total pumping time minus spurt time ($t_p - t_s$), in feet, which may be evaluated from the relationship:

$$L_s = L_p((t_p - t_s)/t_p)^{n1}$$

EQUATION 8

$t_x$ represents the time required for the fracturing fluid to reach a distance x, in minutes; and $L_p$ represents the halfwing created length for the established pumping time ($t_p$).

As will be appreciated by those skilled in the art, the above integral expressions may be represented as follows:

$$V_{1c} = C_{vc} f_{1vc} + C_w f_{1w}$$

EQUATION 9 and $$V_{1p} = C_{vc} f_{2vc} + C_w f_{2w}$$

EQUATION 10

The function terms of equations 9 and 10 are found in the integral expressions of equations 6 and 7. The "$f_{vc}$" terms represent those functions relating to the coefficient of early time fluid loss ($C_{vc}$) and the "$f_{1w}$" terms represent the integral expressions relating to the coefficient of late time fluid loss ($C_w$).

For example, function $f_{1vc}$ of equation 9 may be expressed in relation to equation 6 as follows:

$$f_{1vc} = 4H_n \int_0^{L_s} \int_{t_p}^{t_s + t_x} \frac{dxdt}{(t - t_x)^{\frac{1}{2}}} + 4H_n \int_{L_s}^{L_p} \int_{t_p}^{t_p + t_c} \frac{dxdt}{(t - t_x)^{\frac{1}{2}}}$$

EQUATION 11

Similarly, the function terms $f_{1w}$ of equation 9 may be expressed in relation to equation 6 as follows:

$$f_{1w} = 4H_n \int_0^{L_s} \int_{t_s + t_x}^{t_p + t_c} \frac{dxdt}{(t - t_x)^{\frac{1}{2}}}$$

EQUATION 12

The function $f_{2vc}$ of equation 10 may be expressed in relation to equation 7 as follows:

$$f_{2vc} = 4H_n \int_0^{L_s} \int_0^{t_s + t_x} \frac{dxdt}{(t - t_x)^{\frac{1}{2}}} +$$

EQUATION 13

-continued $$4H_n \int_{L_s}^{L_p} \int_{t_p}^{t_c + t_p} \frac{dxdt}{(t - t_x)^{\frac{1}{2}}}$$

Similarly, $f_{2w}$ term of equation 10 may be expressed as follows:

$$f_{2w} = 4H_n \int_0^{L_s} \int_{t_s + t_x}^{t_p} \frac{dxdt}{(t - t_x)^{\frac{1}{2}}}$$

EQUATION 14

The fluid efficiency ($\delta$) is known from the first mini-frac treatment through observation of the pressure decline curve. Fluid efficiency may also be expressed as a function of the volume of fluid loss during closure and the volume of fluid loss during pumping as follows:

$$\zeta = v_{1c}/(v_{1p} + v_{1c}) = \frac{(C_{vc} f_{1vc} + C_w f_{1w})}{(C_{vc} f_{1vc} + C_w f_{1w}) + (C_{vc} f_{2vc} + C_w f_{2w})}$$

EQUATION 15

Since the late time fluid loss Coefficient ($C_w$) is known from the second mini-frac operation, equation 15 may be solved for the early time fluid loss $C_{vc}$.

The value of the early time fluid loss coefficient ($C_{vc}$) so determined may then be checked by the balance equation:

$$V_{sp} = 2C_{vc} t_s^{\frac{1}{2}}$$

where the spurt loss volume was previously empirically determined in the laboratory, and wherein the value assigned for the spurt time ($t_s$) is the maximum spurt time previously utilized in the integral expressions of equations 6 and 7. In most circumstances, the empirically determined spurt loss volume ($V_{sp}$) will be substantially greater than the calculated value on the right side of equation 12. Where this is the case, a different, lower, magnitude of spurt time ($t_s$) may be inserted into the integral expressions of equations 6 and 7, and the above procedure may be iteratively followed until balance equation 16 agrees within an acceptable margin of error, for example, 0.01%.

As the spurt time is reevaluated during these iterations, the assigned spurt time for each iteration should be evaluated relative to the pumping time and closure time to determine if the iteratively assigned value will alter the "categories" discussed earlier herein. Where the change in the assigned spurt time value causes a change to the next category, the integral expression for $V_{1c}$ will change. For example, where the iteratively assigned spurt time falls within category three, the integral expression of $V_{1c}$ will be as follows:

$$V_{1c} = 4H_n \int_0^{L_s} \int_{t_p}^{t_p + t_c} C_w \frac{dxdt}{(t - t_x)^{\frac{1}{2}}} + 4H_n \int_{L_s}^{L_{sc}} \left[ \int_{t_p}^{t_s + t_x} C_{vc} + \int_{t_s + t_x}^{t_p + t_c} C_w \right] \frac{dxdt}{(t - t_x)^{\frac{1}{2}}} + 4H_n \int_{L_{sc}}^{L_p} \int_{t_p}^{t_p + t_c} C_{vc} \frac{dxdt}{(t - t_x)^{\frac{1}{2}}}$$

EQUATION 17 where:

$L_{sc}$ represents the halfwing created length as may be determined from the relationship:

$$L_{sc}=L_p((t_p+t_c-t_s)/t_p)^{n_1} \quad \text{EQUATION 18}$$

where:

$t_s$ represents the presently interatively assigned value for the spurt time, and $n_1$ represents the power law model exponent for length in the 2d constant height models. In the presently preferred implementations of the present invention, the $n_1$ exponent will preferably be established at a value of $\frac{2}{3}$.

Similarly, if the iteratively assigned spurt time becomes of a magnitude to be placed in category four, the integral expression of $V_{1c}$ is as follows:

$$V_{1c} = 4H_n \int_0^{L_s} \int_{t_p}^{t_p + t_c} C_w \frac{dxdt}{(t - t_x)^{\frac{1}{2}}} + 4H_n \int_{L_s}^{L_p} \left[ \int_{t_p}^{t_s + t_x} C_{vc} + \int_{t_s + t_x}^{t_p + t_c} C_w \right] \frac{dxdt}{(t - t_x)^{\frac{1}{2}}} \quad \text{EQUATION 19}$$

With each of the integral expressions of equations 6, 17 and 19 for the fluid loss during shut-in, the iterative procedure is the same until the equivalent expressions of balance equation 16 are within the acceptable margin of tolerance.

Because the initially assumed spurt time will almost always be too high, the known spurt volume of balance equation 16 should initially be too high. As the iterations with different assigned spurt times ($t_s$) progress, if the right side of balance equation 12 becomes greater than the known spurt volume, it will be recognized that the assumed spurt time is of too low a magnitude.

Once the balance equation (equation 16) is satisfied within an acceptable tolerance, the determined early time fluid leak-off coefficient ($C_{vc}$) and late time fluid leak-off coefficient ($C_w$) may be utilized in a conventional fracture model to evaluate fracture performance similarly to fracture geometry (i.e., the length and width), with increased accuracy. For example, the coefficients may be utilized in the Perkins and Kern fracture model as follows:

$$\frac{q_o}{h_f} = \frac{3\pi}{8} w \frac{dL}{dt} + 2 \int_0^{t_s} C_{vc} \frac{dL}{dt} \frac{dt}{t - \tau} + 2 \int_{t_s}^{t} C_w \frac{dL}{d\tau} \frac{d\tau}{t - \tau} \quad \text{EQUATION 19}$$

$q_o$ represents the flow rate at the fracture entrance ($x/L=\lambda$=dimensionless fracture coordinate;

$h_f$ represents the fracture height (a constant for a two dimensional model as presented here;

w represents the fracture width;

L represents the fracture length;

t represents the time in minutes; and $\tau$ represents the time at which fluid loss starts.

As will be appreciated by those skilled in the art, the equation for a three dimensional design model will be of generally the same form; however, the fracture height ($h_f$) is a variable and must be multiplied through the equation, with each integral on the right side of the equation becoming a double integral.

As an alternative method of practicing the invention, instead of determining the spurt volume ($V_{sp}$) empirically, a value for the early time fluid loss coefficient ($C_{vc}$) may be calculated in a conventional manner in relation to the formation permeability to liquid, the viscosity of the fluid leaking into the formation, the pressure differential between the fracture and reservoir pressures, formation porosity, the isothermal compressibility of the reservoir fluid, and reservoir fluid viscosity. Such calculations are well known to those skilled in the art.

The $C_{vc}$ and $C_w$ coefficients may then be utilized in the appropriate integral expressions, such as equation 6 and 7 to determine a spurt time. The fluid efficiency equation, equation 15, may then be utilized as a balance equation to determine the accuracy of the determined spurt time ($t_s$). When the known value of fluid efficiency (from the first mini-frac) agrees with the determined value by fluid efficiency balance equation 15, the determined spurt time may then be utilized to calculate the spurt volume through the relationship set forth in equation 16.

As with the previously described method, the determining of the spurt time in this manner will be an iterative process. As each new iteratively-assigned spurt time is utilized in the integral expressions, the assigned spurt time must be compared to the categories defined by equations 2, 3, 4, and 5 to assure that the appropriate integral expression for the volume of fluid loss during shut-in is selected from equations 6, 17, and 19. Once the spurt volume and the spurt time are determined in this manner, such determined values may be utilized to solve a conventional fracture model, such as is found in equation 20.

Many modifications and variations may be made in the techniques and structures described and illustrated herein without departing from the spirit and scope of the present invention. Accordingly, it should be readily understood that the preferred embodiments and implementations of the invention described herein are illustrative only, and are not to be considered as limitations on the present invention.

What is claimed is:

1. A method of predicting fluid loss into a formation during a subsurface fracturing operation, comprising the steps of:

pumping fluid into said formation to establish a test fracture in said formation;

determining the fluid efficiency of said formation in reference to said establishing of said fracture;

determining the spurt volume of said formation; pumping fluid into said formation to re-open said fracture;

determining a leak-off coefficient of fluid into said formation in reference to said re-opening of said fracture; and determining a parameter of a fracturing program for said formation in reference to said leak-off coefficient and to said determined fluid efficiency.

2. The method of claim 1, wherein said leak-off coefficient is utilized to determine the total fluid loss values into the formation during shut-in and the total fluid loss values into the formation during pumping, and wherein said fluid loss values are utilized to determine at least one parameter of a said fracturing program.

3. The method of claim 1, wherein said fluid leak-off coefficient is representative of the late time fluid loss coefficient.

4. A method of evaluating characteristics of a subsurface formation fracturing program, comprising the steps of:

pumping fluid into said formation for a first predetermined time period;

shutting in said formation for a second predetermined time period, to establish pressure decline data for said formation;

determining the fluid efficiency of said formation in response to said pressure decline data;

pumping fluid into said formation for a third predetermined time period;

shutting in said formation for a fourth predetermined time period; and determining a late time fluid leak-off coefficient in response to said pumping of said third predetermined time period and said shut-in of said fourth determined time period;

utilizing said determined late time fluid leak-off coefficient and said fluid efficiency to determine an early time fluid leak-off coefficient.

5. The method of claim 4, further comprising the step of determining the spurt volume of said formation, and wherein said early time fluid leak-off coefficient is further determined in response to said determined spurt volume.

6. The method of claim 5, wherein said third time period of pumping and said fourth time period of shut-in define pressure decline characteristics functionally representative of said second determined fluid loss coefficient.

7. A method of evaluating characteristics of a subsurface formation fracturing program, comprising the steps of: pumping fluid into said formation for a first pumping time; shutting in said formation for a first shut-in time to establish pressure decline data; determining a fluid efficiency for said formation from said first pumping time and said first shut-in time: determining the spurt volume of said formation; pumping fluid into said formation for a second pumping time to reopen said fracture;

shutting in said formation for a second shut-in time to determine a second set of pressure decline data;

determining a late time fluid loss coefficient in response to said second set of pressure decline data; estimating a maximum spurt time for said formation in response to said determined late time fluid leak-off coefficient and said determined formation spurt volume;

utilizing an estimated spurt time not greater than said determined maximum spurt time to determine the volume of fluid loss during pumping and the volume of fluid loss during shut-in for said formation; and functionally relating said determined volumes of fluid loss during shut-in and fluid loss during pumping to said determined fluid efficiency to establish an early time fluid leak-off coefficient for said formation.

8. The method of claim 7 further comprising the step of functionally relating said estimated spurt time and said determined early time fluid loss coefficient to said determined spurt volume in a balance relationship to establish a margin of error within said balance relationship.

9. The method of claim 8, further comprising the steps of:

iteratively changing said estimate spurt time in response to said established margin of error, and iteratively re-determining said total volume of fluid loss during pumping and said total volume of fluid loss during shut-in; and functionally relating said re-determined fluid loss volumes to said fluid efficiency to re-determine an early time fluid loss coefficient functionally relating said re-determined early time fluid loss coefficient to said, re-determined spurt time and said spurt volume until an agreement in said balance relationship within a predetermined tolerance is achieved.

10. The method of claim 7, wherein said step of determining the volume of fluid loss during pumping and the volume of fluid loss during shut-in is performed, at least in part, by solving integral expressions for said volumes.

11. A method of evaluating characteristics of a subsurface formation fracturing program, comprising the steps of:

pumping fluid into said formation for a first pumping time;

shutting in said formation for a first shut-in time to establish a first set of pressure decline data;

determining a fluid efficiency for said formation from said first pumping time and said first shut-in time;

pumping fluid into said formation for a second pumping time to reopen said fracture;

shutting in said formation for a second shut-in time to determine a second set of pressure decline data;

determining a late time fluid loss coefficient in response to said second set of pressure decline data;

determining an early time fluid loss coefficient in response to formation and fracturing fluid parameters;

utilizing said determined early time fluid loss coefficient and said late time fluid loss coefficient to estimate a maximum spurt time;

functionally relating said estimated spurt time to said determined early time fluid loss coefficient to estimate a spurt volume for said formation; and functionally relating said determined early time fluid loss coefficient and said established spurt time to said determined fluid efficiency in a balance relationship to establish a margin of error in said balance relationship; and iteratively changing said first-determined spurt time in response to said established margin of error, and interatively re-determining said spurt volume until a predetermined tolerance in said balance relationship is achieved.

12. The method of claim 11, wherein said step of iteratively re-determining said spurt volume in response to said re-determined spurt time is performed, at least in part, by solving integral expressions representative of the total volume of fluid loss during pumping and the total volume of fluid loss during shut-in.

* * * * *

UNITED STATES PATENT AND TRADEMARK OFFICE

CERTIFICATE OF CORRECTION

PATENT NO. : 5,241,475

DATED : August 31, 1993

INVENTOR(S) : Wellington S. Lee, et al

It is certified that error appears in the above-indentified patent and that said Letters Patent is hereby corrected as shown below:

In column 4, line 40, "$\leqq$" should be "$\leq$".

In column 4, line 46, after $t_c$, "$\leqq$" should be "$\leq$".

In column 4, line 46 after $t_s$, "$\leqq$" should be "<".

In column 6, line 13, "($\delta$)" should be "($\zeta$)".

Signed and Sealed this

Twenty-second Day of March, 1994

*Attest:*

Bruce Lehman

BRUCE LEHMAN

*Attesting Officer*

*Commissioner of Patents and Trademarks*